United States Patent [19]

Wrob et al.

[11] 4,112,410

[45] Sep. 5, 1978

[54] HEATER AND METHOD OF MAKING SAME

[75] Inventors: Ronald M. Wrob, Kirkwood; Jeffrey P. Melly, St. Louis, both of Mo.

[73] Assignee: Watlow Electric Manufacturing Company, St. Louis, Mo.

[21] Appl. No.: 744,961

[22] Filed: Nov. 26, 1976

[51] Int. Cl.[2] ..... H01C 1/028

[52] U.S. Cl. ..... 338/243; 29/611; 338/267; 338/270; 338/271; 338/279; 338/302; 338/331

[58] Field of Search ..... 338/243, 246, 238, 239, 338/261, 264, 265, 267, 270–273, 279, 296, 297; 219/541, 542, 544, 546, 552, 553, 278, 353, 354; 29/611, 620, 621

[56] References Cited

U.S. PATENT DOCUMENTS

| | | | |
|---|---|---|---|
| 2,053,933 | 9/1936 | Abbott | 338/273 X |
| 2,808,492 | 10/1957 | Yohe | 29/611 X |
| 3,521,352 | 7/1970 | Volker | 29/611 |

*Primary Examiner*—C. L. Albritton

*Attorney, Agent, or Firm*—Koenig, Senniger, Powers and Leavitt

[57] ABSTRACT

A heater comprising a metallic tubular sheath in which an elongate electrical center conductor is coaxially disposed therewithin. A fibrous, inorganic electrical insulation material is wrapped around the center conductor and an electrical resistance heating element surrounds the enwrapped center conductor, the heating element being coaxial with the center conductor and electrically connected thereto with the heating element and the conductor being adapted to be connected to a source of electrical power to energize the heating element. Other electrical insulation material is disposed between the heating element and the sheath to electrically insulate the heating element from the sheath and to provide a conductive heat transfer path between the heating element and the sheath. A method of manufacturing a heater is also disclosed.

8 Claims, 7 Drawing Figures

HEATER AND METHOD OF MAKING SAME cl BACKGROUND OF THE INVENTION

This invention relates to electrical resistance heaters and more particularly to cartridge-type electrical resistance heaters.

This invention is broadly related to heaters of the type described in the coassigned Desloge and Wrob U.S. Pat. Nos. 2,831,951 and 3,970,822, respectively, in which an electrical resistance heating element is formed about a ceramic core. Alternately, the heating element may be formed about an electrical center conductor and in either case the resulting assembly is inserted in a tubular metal sheath of somewhat larger diameter than the assembly. A particulate insulation material, such as magnesium oxide (MgO) powder, is poured into the annular space between the heating assembly and the inside face of the sheath. When in place, the sheath is subjected to a diameter reduction process (i.e., swaged) in which the ceramic core in the one type heater is partially crushed and in which the insulation material in both type heaters is compressed about the heating element. This results in an increase in both the dielectric strength and thermal conductivity of the insulation material. It is desirable that both these values be as high as possible with the layer of insulative material between the heating element and the sheath as thin as possible thus to provide maximum heat transfer from the heating element to the sheath while maintaining adequate electrical insulation between the heating element and the sheath.

For some applications, relatively small heaters, (e.g., heaters having an outside diameter of 0.3 inch (0.76 cm) or less) having high heat flux outputs (e.g., 500 – 1000 watt/in.$^2$) are required. In such heaters, the annular space between the heating element and the inside of the sheath may be so small, for example, 0.015 inch (0.04 cm) or less, that powdered insulation material cannot be poured into the heater to fill this space. In addition to providing a layer of insulation material of uniform thickness to electrically insulate the various components of the heater, it is necessary to insure that the insulation layer is not unduly thick, even in local areas, as it would impede the transfer of heat from the heating element to the exterior of the heater and increase the operating temperature of the heating element. An increase in temperature of the heating element of only a relatively small amount (e.g., 5 – 10 percent) may significantly decrease the service life of the heater.

SUMMARY OF THE INVENTION

Among the several objects of the present invention may be noted the provision of a heater having a relatively small outside diameter and a method for manufacturing the heater; the provision of such a heater in which its heating element is effectively electrically insulated to prevent electrical shorting thereof; the provision of such a heater having a relatively high heat transfer rate between its heating element and its sheath; the provision of such a heater which can be operated at high heat flux levels for extended periods without breakdown; the provision of such a heater and method in which electrical insulation material may be uniformly applied to both the center conductor and to the heating element and in which close tolerances of the insulation thickness can be readily controlled; and the provision of such a heater which has a long operating life.

Briefly, a heater of the present invention comprises a metallic tubular sheath. An elongate electrical conductor is substantially coaxially disposed in the sheath. A fibrous, inorganic electrical insulation material surrounds the conductor and an electrical resistance heating element surrounds the insulated center conductor, the heating element being substantially coaxial with the center conductor and electrically connected thereto. The heating element and the conductor are adapted to be connected to a source of electrical power to energize the heating element. Other electrical insulation material is disposed between the heating element and the sheath to electrically insulate the heating element from the sheath and provide a conductive heat transfer path between the heating element and the sheath.

The method of this invention of manufacturing an electrical resistance heater, such as above-described, comprises wrapping the center conductor with a fibrous, inorganic insulation material. The electrical resistance heating element is then applied to the enwrapped center conductor so that the heating element and the center conductor are substantially coaxial. The center conductor is electrically connected to the heating element and the heating element and the center conductor are inserted into the sheath. The heating element is electrically insulated from the sheath and the fibrous insulation material is compressed after assembly of the heater. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figures 1, 2, 3A, 3B, 3C, 3D, 3E:
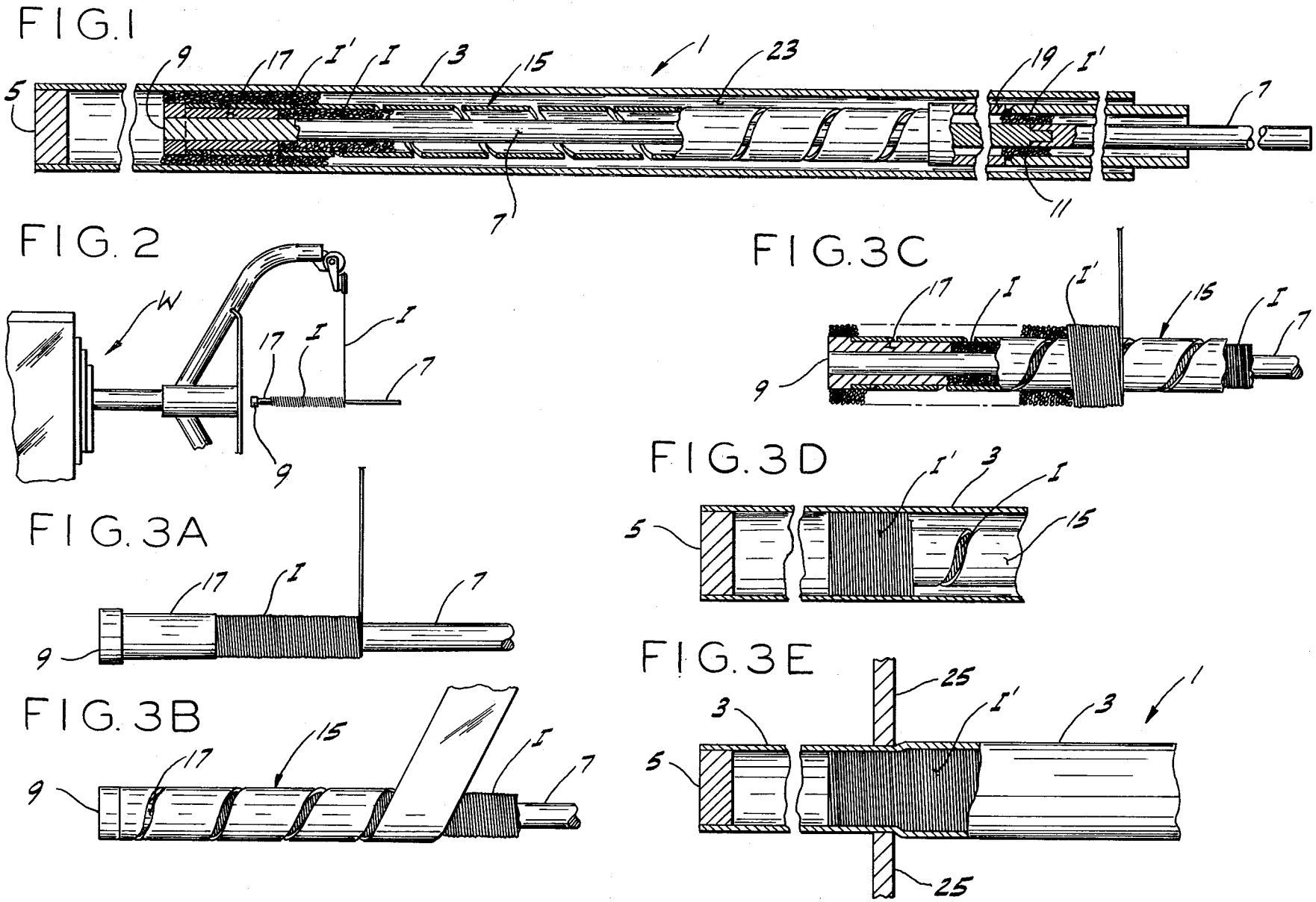
FIG. 1 is an enlarged longitudinal cross section of a heater of the present invention.
FIG. 2 is a diagrammatic view depicting an inorganic fibrous insulation material being wrapped around a center conductor of the heater of this invention.
FIGS. 3A–3E depict the various steps in the method of the present invention for manufacturing a heater as illustrated in FIG. 1.

Referring now to the drawings, a heater of the present invention, indicated in its entirety at 1, comprises a tubular metal sheath 3 of stainless steel or other high temperature material closed at one end by a closure plug 5. An elongate electrical center conductor 7 is disposed within sheath 3 and is coaxial therewith. The center conductor may, for example, be a solid rod of copper or other electrical conductive metal. A fibrous, inorganic electrical insulation material I is wrapped around conductor 7 from one end 9 of the conductor to the other end 11 thereof.

An electrical resistance heating element 15 surrounds the insulated center conductor. The heating element may, for example, be a strip of a suitable electric resistance heating material, such as a nickel, chromium alloy known by the trade designation NICHROME, which is wound in a spiral around the outside of the insulative material I on the center conductor so as to be coaxial with center conductor 7. A sleeve 17 made of an electrically conductive material is fitted over end 9 of the insulated center conductor so as to be in electrical contact with the center conductor. Heater strip 15 is secured to sleeve 17 and is spirally wound about the enwrapped or insulated center conductor. A second sleeve 19 of electrically conductive material is fitted over end 11 of the insulated center conductor. Insulation I prevents sleeve 19 from making electrical contact with the center conductor. Heater strip 15 is secured to sleeve 19 to make electrical contact therewith. The tubular sleeve 19 extends endwise from sheath 3 and conductor 9 extends beyond the sleeve. The extensions of sleeve 19 and conductor 7 thus constitute terminals which may be electrically connected to a source of electrical power to energize heater strip 15.

As indicated at 23, an annular space exists between insulated center conductor 9 and sheath 3. Other electrical insulation material I' is disposed within space 23 to electrically insulate heating strip 15 and sleeves 17 and 19 from sheath 3 and to provide a conductive heat transfer path between strip 15 and the sheath. If annular space 23 is sufficiently large, a dry, powdered or particulate electrical insulative material, such as magnesium oxide (MgO) powder, may be poured thereinto. If, on the other hand, space 23 is so small as to prevent powdered insulative material to be poured between the enwrapped center conductor and the sheath, the insulated center conductor 9 with insulation I and heater strip 15 enwrapped therearound may be wrapped with a fibrous, inorganic insulation material similar to insulation I and then inserted into the sheath.

After assembling sheath 1 as above-described, the heater is uniformly compressed or compacted along its length by a diameter reduction process, such as by swaging, to uniformly reduce the diameter of sheath 3 and to uniformly compact insulation layers I and I'. This results in a uniform layer of electrical insulation I between conductor 7 and heating element 15 and between the heating element and sheath 3 to prevent electrical shorting of heating element 15, particularly to sheath 3, which would render heater 1 inoperable. As will be hereinafter described, compaction of the fibrous insulation I and I' increase their thermal conductivity so as to maximize the output of heating element 15.

Heater 1, as above-described, may be several inches long and an outer diameter after compaction (i.e., swaging) of about 0.30 inches or less. For example, the outside diameter of sheath 3 before swaging may be 0.320 inches and about 0.294 inches after swaging. This heater may be operated at relatively high heat flux levels ranging, for example, between about 500 – 1000 W/in$^2$ with 100 amp current being supplied to the heater at 150 – 200 volts.

The fibrous, inorganic electrical insulation material above-described is preferably a ceramic yarn having a minimum electrical resistivity of about $10^5$ ohm/cm. and a minimum thermal conductivity of about 20 BTU/hr./ft$^2$/(°F/in) at 1800° C. (982° C.) when compressed within the heater. Preferably, boron nitride (BN) yarn, commercially available from the Carborundum Company of Niagara Falls, N.Y., is utilized as the fibrous insulation material for insulation I or I' because of its relatively high electrical resistivity and thermal conductivity. For example, the manufacturer of boron nitride fiber yarn reports its resistivity is $1.0 \times 10^9$ ohm/cm. at 1800° F. (982° C.). It will also be noted that boron nitride fibers offer good resistance to oxidation at temperatures below 1500° F. (816° C.) and then become coated with boron oxide which protects against further oxidation to 2350° F. (1288° C.) The thermal conductivity of solid boron nitride is high for a ceramic material. Generally, the thermal conductivity of boron nitride compares quite well to stainless steel. The thermal conductivity of boron nitride fibers is, however, a function of the surface contact between individual fibers, compaction and fiber direction. At 340° F. (171° C.) boron nitride felt having a density of 3.4 lb./ft.$^3$ is reported by its manufacturer to have a coefficient of thermal conductivity of about 1.1 B/hr./ft./ft.$^2$/(°F./in.). Upon boron nitride yarn enwrapping center conductor 7 and heating element 15 being compacted within heater 1 in accordance with this invention, the thermal conductivity of the compacted boron nitride yarn constituting insulation I and I' will exceed 20 B/hr.ft.$^2$(°F./in.) and may range as high as 100 B/hr./ft.$^2$/(°F./in.).

Boron nitride fiber yarn is, however, relatively expensive costing about $600 – $1000 per pound. In accordance with this invention, other lower cost inorganic fibrous insulation materials, as aluminum oxide, zirconium oxide, and magnesium oxide fiber yarns, may be used in place of boron nitride fiber yarn so long as these other insulation materials have a minimum electrical resistivity of about $10^5$ ohm/cm. and a minimum thermal conductivity of about 20 BTU/hr./ft.$^2$/(°F./in.) at 1800° F. (982° C.) when compacted in the heater. For example, a ceramic fiber yarn commercially available from the 3M Company of St. Paul, Minn. under their trade designation AB312 may be used. This yarn is made of aluminia, boria and silica.

In accordance with the method of this invention for manufacturing heater 1, sleeve 17 is secured to end 9 of conductor 7 to be in electrical contact therewith and center conductor 7 is wrapped with fibrous, inorganic insulation material I, such as a ceramic fiber yarn. As shown in FIGS. 2 and 3A, the yarn is wrapped onto the center conductor by a conventional wrapping machine W at a desired tension until a uniform layer of desired thickness is wound on the conductor.

Next, electrical resistance heating element 15 is applied to the enwrapped center conductor 7 so that the heating element is in electrical contact with sleeves 17 and 19 and so that the heating element and the center conductor are coaxial (see FIG. 3B). This may be accomplished by first securing the heating element to sleeve 17 and by spirally wrapping the heating element (e.g., a nichrome ribbon) around the layer of insulation I previously wrapped about the center conductor. Sleeve 19 is then fitted over insulation I on end 11 of conductor 7 and the heating element is electrically connected thereto. Alternately, heating element 15 may be a continuous tubular nichrome heater or a nichrome tube which is fitted over the enwrapped center conductor so that sleeves 17 and 19 hold the tube in place and make electrical contact therewith. A helical pattern may then be marked on the tube and the tube etched away to form a helical resistor around the outside of the enwrapped center conductor. When the heating element has been applied, electrical contact between it and center conductor 7 is made through sleeve 19 and the outer extension of the center conductor so that sleeve 19 and the center conductor extension constitute terminals which may be connected to a source of electrical power to energize the heater.

Depending upon the inside diameter of sheath 3 and the diameter of the resulting assembly hereinabove described, one of two steps is next performed. If the annular space 23 between sheath 3 and the center conductor-heating element assembly is large enough so that it may be filled with a particulate insulation material, the assembly is inserted into sheath 3 and aligned so as to be coaxial therewith. Then, particulate insulation material I' such as magnesium oxide (MgO) powder, is poured into the sheath until the annular space between the heating element and the sheath is filled. If the annular space is not large enought to permit powdered material to be poured into it, then fibrous, inorganic insulating material such as a boron nitride fiber is wrapped about heating element 15 (as shown in FIG. 3C) to form a uniform layer of electrical insulation I' of desired thickness. After this is done, the assembly is inserted into sheath 3 and aligned so as to be coaxial therewith (see FIG. 3D).

After assembly of heater 1, the fibrous insulation material I and I' is compressed (as shown in FIG. 3E) by subjecting the heater to a diameter reduction or swaging process. In this swaging process, heater 1 assembly is drawn between two dies 25 which repetitively impact upon sheath 3 to uniformly reduce the diameter of the sheath along its length and to simultaneously compress the insulation materials I and I' within the sheath to a desired thickness and compactness. Compression of the fibrous, inorganic insulation material within heater 1 (and the particulate insulation material, if used) serves to increase both the dielectric strength and thermal conductivity of the insulation. When swaging is completed, heater 1 has a uniform layer of insulation I of a desired degree of compaction or density and a desired minimum thickness between center conductor 7 and heating element 15 which effectively electrically insulates the heating element from the center conductor, and a uniform layer of insulation I' of a desired thickness between the heating element and the inside of sheath 3. The thickness of insulation I' after compaction (i.e., after swaging) is so sized that it reliably electrically insulates heating element 15 from sheath 3, even at relatively high current and voltage levels, and yet presents the least resistance possible to the transfer of heat from the heating element to the sheath.

The method and heater of this invention, and more particularly, the use of fibrous inorganic electrical insulation permits small diameter high heat flex heaters to be readily manufactured at relatively low cost with the heater having an optimum amount of electrical insulation therein to reliably insulate the components of the heater for preventing electrical shorts and for providing a long service life and to improve the efficiency of the heater.

It will be understood that the above described method of manufacturing a heater 1 may also be used to manufacture a heater such as that disclosed in coassigned U.S. Pat. No. 3,970,822 in which an elongate heating element of generally circular cross-section, such as therein described, is disposed in a metallic tubular sheath substantially coaxial therewith. Instead of a particulate insulating material being poured into the sheath to fill the annular space between the heating element and the sheath, the heating element therein disclosed may be wrapped in a fibrous, inorganic insulating material, such as ceramic fiber yarn, and then disposed in the sheath which then undergoes a diameter reduction process to uniformly compress the heater along its length and to compress the layer of fibrous insulation material to a uniform desired thickness. A heater of the type disclosed in the aforementioned patent then has a uniform layer of specified minimum thickness of insulation between the heating element and the sheath to effectively electrically insulate the heating element from the sheath and maximize the transfer of heat from the heating element to the sheath.

It will also be understood that in accordance with this invention that the inorganic, fibrous insulation material I or I' discussed above, may be in the form of woven or non woven cloth or tape as well as a yarn.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A heater comprising:

a metallic tubular sheath;

an elongate electrical conductor disposed substantially coaxially within said sheath;

fibrous, inorganic electrical insulation material surrounding said conductor;

an electrical resistance heating element surrounding said insulated center conductor, the heating element being substantially coaxial with the center conductor and electrically connected thereto and said heating element and said conductor being adapted for connection to a source of electrical power to energize the heating element; and other electrical insulation material disposed between said heating element and said sheath to electrically insulate the heating element from the sheath and provide a conductive heat transfer path between the heating element and the sheath.

2. A heater as set forth in claim 1 wherein the other electrical insulation material is also a fibrous, inorganic electrical insulation material.

3. A heater as set forth in claim 2 wherein said fibrous insulation materials are uniformly compressed within said sheath.

4. A heater as set forth in claim 3 wherein said fibrous insulation materials have a minimum electrical resistivity of about $10^5$ ohm/cm at a temperature at 1800° F. (982° C.) when compressed within said sheath.

5. A heater as set forth in claim 4 wherein the fibrous insulation materials have a minimum thermal conductivity of about 20 BTU/ft$^2$/(°F/in.) at 1800° F. (982° C) when compressed in said heater.

6. A heater as set forth in claim 1 wherein said fibrous insulation material is a ceramic fiber yarn.

7. A heater as set forth in claim 1 wherein said fibrous insulation material is boron nitride yarn.

8. A heater comprising:

a metallic tubular sheath;

an elongate, solid metal center conductor;

fibrous, inorganic electrical insulation material enwrapped around said center conductor;

an elongate electrical resistance heating element wrapped around said insulated center conductor, said heating element being substantially coaxial with said center conductor;

said insulated center conductor with heating element thereon being positioned substantially coaxially within said sheath with one end of said center conductor extending out beyond one end of said sheath, said center conductor being electrically connected to said heating element within said sheath adjacent the other end of said center conductor, said one end of said center conductor being adapted to be connected to a source of electrical power and constituting a terminal for said heater;

a sleeve of electrically conductive material fitted on said center conductor and being electrically insulated therefrom by said insulation material, said sleeve being in electrical contact with said heating element and extending out from said one end of said sheath, said sleeve being adapted to be electrically connected to a source of electrical power and thus constituting a second terminal for said heater, said first and second terminals extending from the same end of said sheath; and other electrical insulation material disposed between said heating element and said sheath and between said sleeve and said sheath thereby to electrically insulate the heating element from the sheath, to provide a conductive heat transfer path between the heating element and the sheath, and to electrically insulate the sleeve from said sheath.

* * * * *